US011440326B2

(12) United States Patent
Fukumoto et al.

(10) Patent No.: US 11,440,326 B2
(45) Date of Patent: Sep. 13, 2022

(54) LIQUID EJECTION APPARATUS

(71) Applicant: CANON KABUSHIKI KAISHA, Tokyo (JP)

(72) Inventors: Yoshiyuki Fukumoto, Kanagawa (JP); Hiroshi Higuchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 1 day.

(21) Appl. No.: 17/143,963

(22) Filed: Jan. 7, 2021

(65) Prior Publication Data

US 2021/0221142 A1 Jul. 22, 2021

(30) Foreign Application Priority Data

Jan. 20, 2020 (JP) ..... JP2020-006648

(51) Int. Cl.
*B41J 2/175* (2006.01)

(52) U.S. Cl.
CPC ..... *B41J 2/17506* (2013.01); *B41J 2/17553* (2013.01)

(58) Field of Classification Search
CPC ..... B41J 2/17506; B41J 2/17553
See application file for complete search history.

(56) References Cited

U.S. PATENT DOCUMENTS

2014/0104349 A1* 4/2014 Kimura ..... B41J 2/17553 347/85

FOREIGN PATENT DOCUMENTS

JP 2017-081173 5/2017

* cited by examiner

*Primary Examiner* — Justin Seo
(74) *Attorney, Agent, or Firm* — Venable LLP

(57) ABSTRACT

A liquid ejection apparatus includes at least one ink tank which is ink-refillable from outside, a liquid ejection head that ejects an ink supplied from the ink tank, and a housing that contains the ink tank and the liquid ejection head inside. The at least one ink tank is fixed to a housing wall of at least one surface out of surfaces forming the housing. Moreover, one surface out of surfaces forming the ink tank, which is attached to the housing wall, is either a surface having the largest area of the ink tank or a surface opposed to the surface having the largest area.

19 Claims, 15 Drawing Sheets

LIQUID EJECTION APPARATUS

BACKGROUND OF THE DISCLOSURE

Field of the Disclosure

This disclosure relates to a liquid ejection apparatus.

Description of the Related Art

Inkjet printers designed to print images by forming inks into droplets and ejecting the droplets onto a sheet surface have been widely used. Such an inkjet printer is configured to supply each ink to a liquid ejection head from a container (called an ink tank) that preserves the ink by using a water head difference or a pump pressure.

Japanese Patent Laid-Open No. 2017-81173 (hereinafter referred to as Reference 1) discloses a printer which is refillable with inks from outside. According to the printer disclosed in Reference 1, in a case where a cover at a front surface of a housing is open, ink tanks are arranged therein. Each of these ink tanks is refilled with an ink by inserting an ink supply port of an ink bottle from outside into an ink filling port located at an upper part of each ink tank.

The aforementioned ink-refillable printer tends to increase a capacity of each ink tank as compared to a printer which is not ink-refillable (such as a printer designed to replace ink tanks one by one). As a consequence, a body of this printer will also be increased in size.

SUMMARY OF THE DISCLOSURE

An aspect of the present disclosure provides a liquid ejection apparatus including at least one ink tank which is ink-refillable from outside, a liquid ejection head configured to eject an ink supplied from the ink tank, and a housing configured to contain the ink tank and the liquid ejection head inside. Here, the at least one ink tank is fixed to a housing wall of at least one surface out of surfaces forming the housing. Moreover, a surface out of surfaces forming the ink tank, which is attached to the housing wall, is any of a surface having the largest area of the ink tank and a surface opposed to the surface having the largest area.

Further features of the present disclosure will become apparent from the following description of exemplary embodiments with reference to the attached drawings.

DESCRIPTION OF THE EMBODIMENTS

Figure 1:
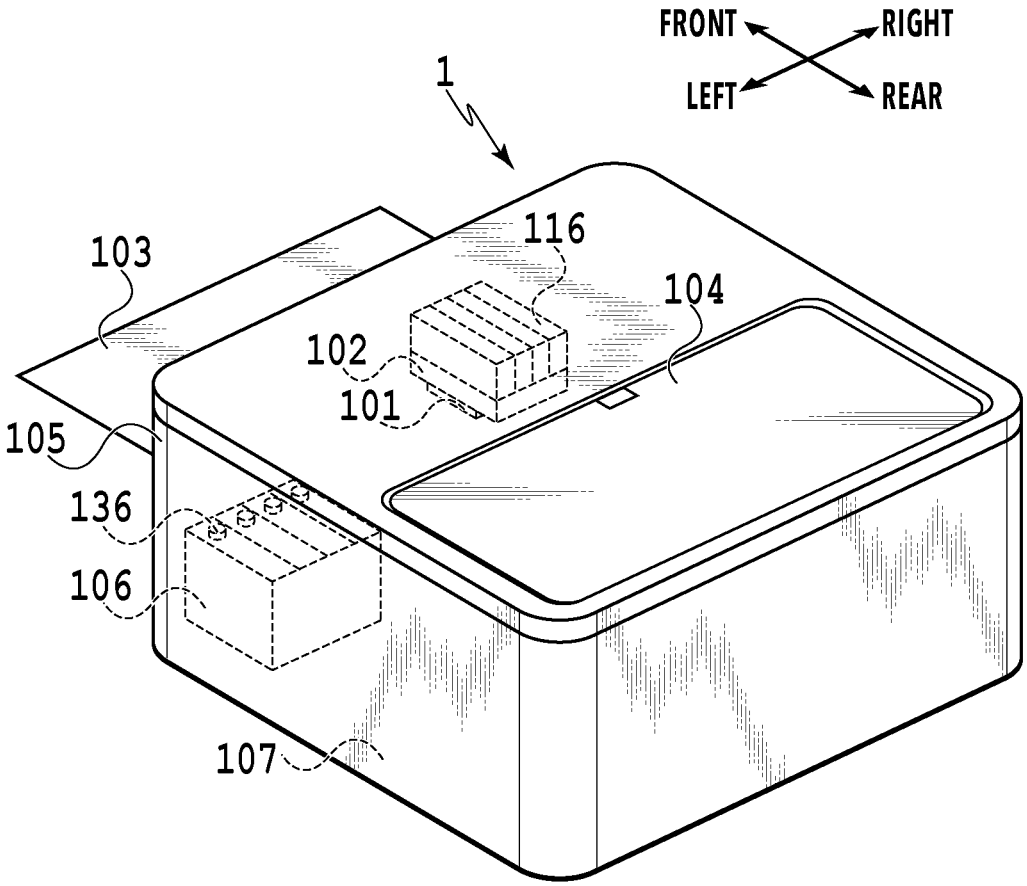
FIG. 1 is a perspective view of a liquid ejection apparatus of a comparative example.

Embodiments of the present disclosure will be described below with reference to the drawings. In the following description, the same constituents will be denoted by same reference numerals. It is to be also noted that relative arrangements, shapes, and so forth described in the embodiments are mere examples.

First Embodiment

A liquid ejection apparatus not according to this embodiment will be explained as a comparative example before discussing about a liquid ejection apparatus (a printing apparatus) of this embodiment. Thereafter, the liquid ejection apparatus of this embodiment will be described. In this specification, reference numerals suffixed with alphabets will represent reference to individual structures while an item in common may be expressed by the reference numeral without suffixed alphabets as appropriate.

FIG. 1 is a perspective view to explain a liquid ejection apparatus 1 of a comparative example. The liquid ejection apparatus 1 is an apparatus configured to eject inks which are liquids. The liquid ejection apparatus 1 is ink-refillable from outside. The liquid ejection apparatus 1 includes a liquid ejection head 101, a carriage 102 that mounts the liquid ejection head 101, ink tanks 106 (liquid tanks), and a housing 105. The housing 105 is located on the outermost side of the liquid ejection apparatus 1 and the interior of the liquid ejection apparatus 1 is covered with box-shaped walls (the housing 105).

The ink tanks 106 are provided near a front left part of the liquid ejection apparatus 1. Note that right-left directions and front-rear directions in this specification are directions in accordance with such directions indicated in the drawings. The liquid ejection apparatus 1 includes a not-illustrated cover used for refilling the ink tanks. Each ink tank 106 is provided with an ink filling port 136. A user can refill each ink tank 106 with an ink by opening the refilling cover and inserting an ink bottle into the ink filling port 136 of the ink tank 106.

The carriage 102 is movable to the right and left inside the housing 105. The carriage 102 scans a print medium (paper) placed below the carriage 102 in the direction of the gravitational force in the right and left directions while ejecting inks, thereby forming an image on the print medium. The image is printed on a sheet surface by repeating the scanning and ink ejection with the carriage 102 while feeding the paper. Sub ink tanks 116 for temporarily storing the inks are installed in the carriage 102. Liquids are supplied from the ink tanks 106 to the sub ink tanks 116.

A paper feed tray 104 is provided on an upper surface of the housing 105. A user opens the paper feed tray 104 and sets the paper so as to feed the paper. The paper is sent below the carriage 102 and subjected to printing. Then, the paper is sent to a paper discharge tray 103 provided at a front face of the housing 105.

The carriage 102 is connected to the ink tanks 106 with not-illustrated ink tubes or the like, and the inks are supplied from the ink tanks 106 to the carriage 102. Each ink tube has a sufficient length and is designed such that a joining portion of the ink tube as well as the ink tube itself are kept from damage while the carriage 102 performs the scanning to the right and left.

Figure 2:
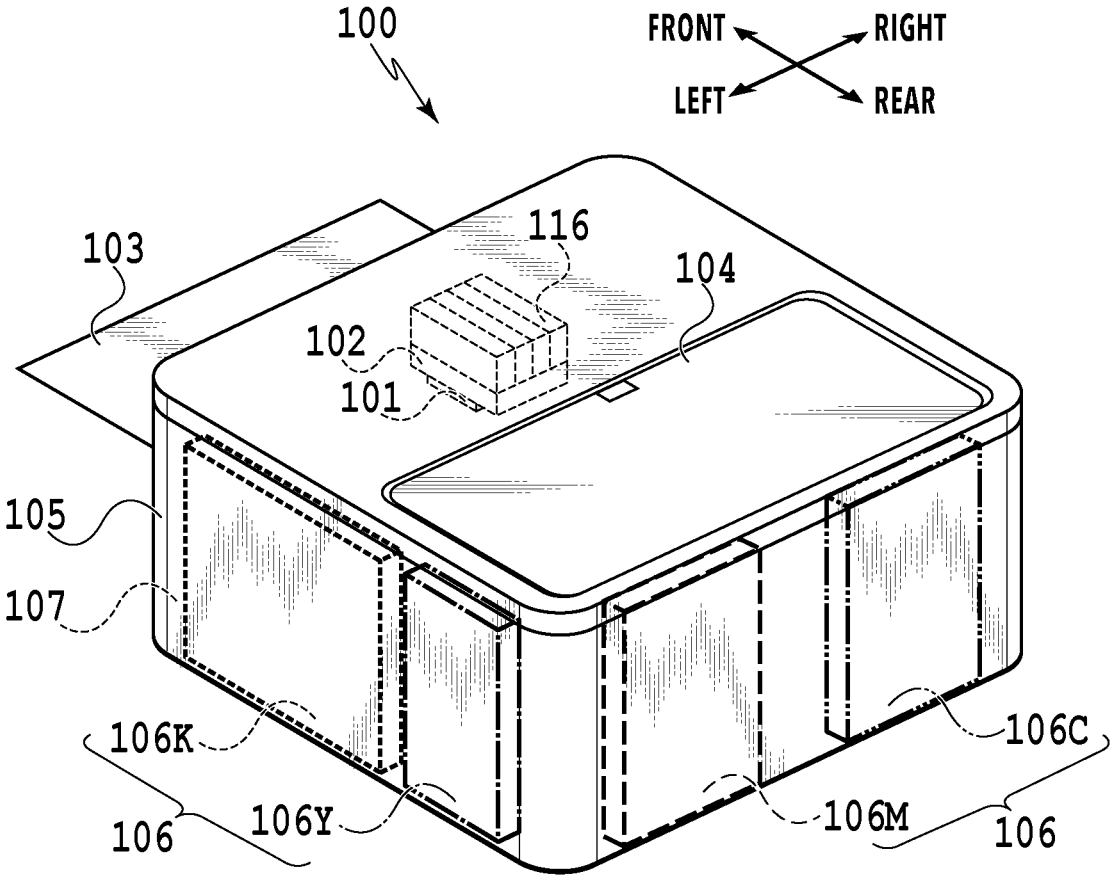
FIG. 2 is a perspective view of a liquid ejection apparatus.

FIG. 2 is a perspective view showing an example of a liquid ejection apparatus 100 of this embodiment. The liquid ejection apparatus 1 shown in FIG. 1 and the liquid ejection apparatus 100 shown in FIG. 2 have substantially the same structures except structures of the housings 105 and the ink tanks 106.

Figure 3:
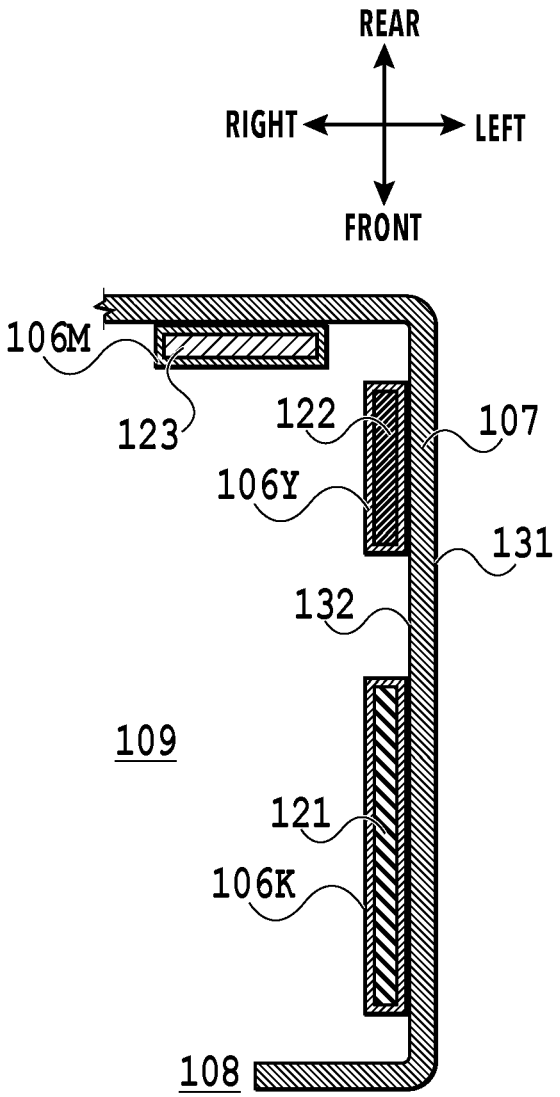
FIG. 3 is a cross-sectional view of the liquid ejection apparatus.

FIG. 3 is a cross-sectional view of the liquid ejection apparatus 100 of FIG. 2 taken along a planar direction thereof, which is a diagram that extracts mainly a left side portion of the housing 105. Now, the housing 105 and the ink tanks 106 of this embodiment will be described with reference to FIGS. 2 and 3.

The housing 105 is constructed by using walls which are continuously provided so as to form a boxed shape. Here, each side of the box is formed from either one wall or walls that are arranged substantially parallel to each other. A wide internal space 109 is formed inside wall surfaces located on the innermost side (hereinafter referred to as housing inner wall surfaces 132) out of the walls constituting the housing 105. At least the liquid ejection head 101 and the ink tanks 106 are installed in the internal space 109. The liquid ejection head 101 and the ink tanks 106 are exposed to the internal space 109 that is covered by the housing 105.

Meanwhile, surfaces on the outermost side of the housing 105 (hereinafter referred to housing outer wall surfaces 131) are exposed to the outside of the liquid ejection apparatus 100. The ink tanks 106 are arranged by being fixed to a wall (a housing wall 107) on one surface out of surfaces that form the housing 105 of the liquid ejection apparatus 100. A lateral direction of each ink tank 106 is preferably arranged in a thickness direction of the housing wall 107 so as to secure a large effective space out of the internal space 109 inside the housing 105. In other words, the ink tanks 106 are preferably arranged in such a way as to minimize the thickness of the housing 105 and the thickness of the ink tanks 106.

In a case where the lateral direction of each ink tank 106 is arranged in the thickness direction of the housing wall 107, the surface out of the surfaces of the ink tank 106 to be fixed to the housing wall 107 is either the surface of the ink tank 106 having the largest area or the surface thereof that is opposed to the surface having the largest area.

By fixing the surface of the ink tank 106 having the largest area or the surface thereof that is opposed to the surface having the largest area to the housing wall 107, the areas of other surfaces of the ink tank 106 can be relatively reduced. The housing wall 107 generally has a larger area than an area of an arbitrary surface of the ink tank 106 like the one used in the comparative example as shown in FIG. 1. As a consequence, it is possible to secure a sufficient capacity of the ink tank 106 even by reducing the areas of the surfaces of the ink tank 106 other than its surface having the largest area or the surface opposed thereto.

In the case where the surface of the ink tank 106 having the largest area or the surface thereof that is opposed to the surface having the largest area is fixed to the housing wall 107 as described above, the longitudinal direction of the ink tank 106 is arranged substantially parallel along the housing wall 107. As a consequence, it is possible to reduce the volume of the ink tanks 106 that bulge into the internal space 109 of the housing 105, and to secure the effective space inside the housing 105. Thus, the liquid ejection apparatus 100 can be reduced in size while securing the required volumes of the ink tanks 106.

Although FIG. 2 illustrates an example in which each ink tank 106 has a rectangular parallelepiped shape, the present disclosure is not limited only to this configuration. For instance, the ink tank 106 may be a cylindrical body of an arbitrary shape having a longitudinal direction such as an elliptic cylinder and a long circular cylinder. Here, this longitudinal direction only needs to be arranged along the housing wall 107.

In the example shown in FIG. 2, an ink tank (black) 106K that involves relatively the largest amount used has the largest capacity. On the other hand, an ink tank (yellow) 106Y has the smallest capacity. The ink tank (black) 106K is fixed to a housing wall 107 on a left side of the housing 105 together with the ink tank (yellow) 106Y. Meanwhile, an ink tank (magenta) 106M and an ink tank (cyan) 106C are fixed to a housing wall 107 on a rear side of the housing 105.

An ink is supplied from each ink tank to the carriage 102 through a flexible ink tube (not illustrated). It is required to avoid a breakage of a joining portion due to a movement of the carriage 102 or to avoid an ink leakage due to a breakage of the ink tube. For this reason, each ink tube has a structure with a high sealing performance and is designed sufficiently long in size.

As shown in FIG. 2, the sub ink tanks 116 for temporarily storing the inks may be installed in the carriage 102. Provision of the sub ink tanks 116 makes it easier to control pressures to be applied to the inks inside the liquid ejection head 101. Nonetheless, the provision of the sub ink tanks 116 may be omitted instead.

The ink tanks 106 may be installed on any of the housing walls 107 that form the housing 105. For example, the ink tanks 106 may be installed in the right and left, upper and lower, or front and rear housing walls 107 of the housing 105.

Figure 4:
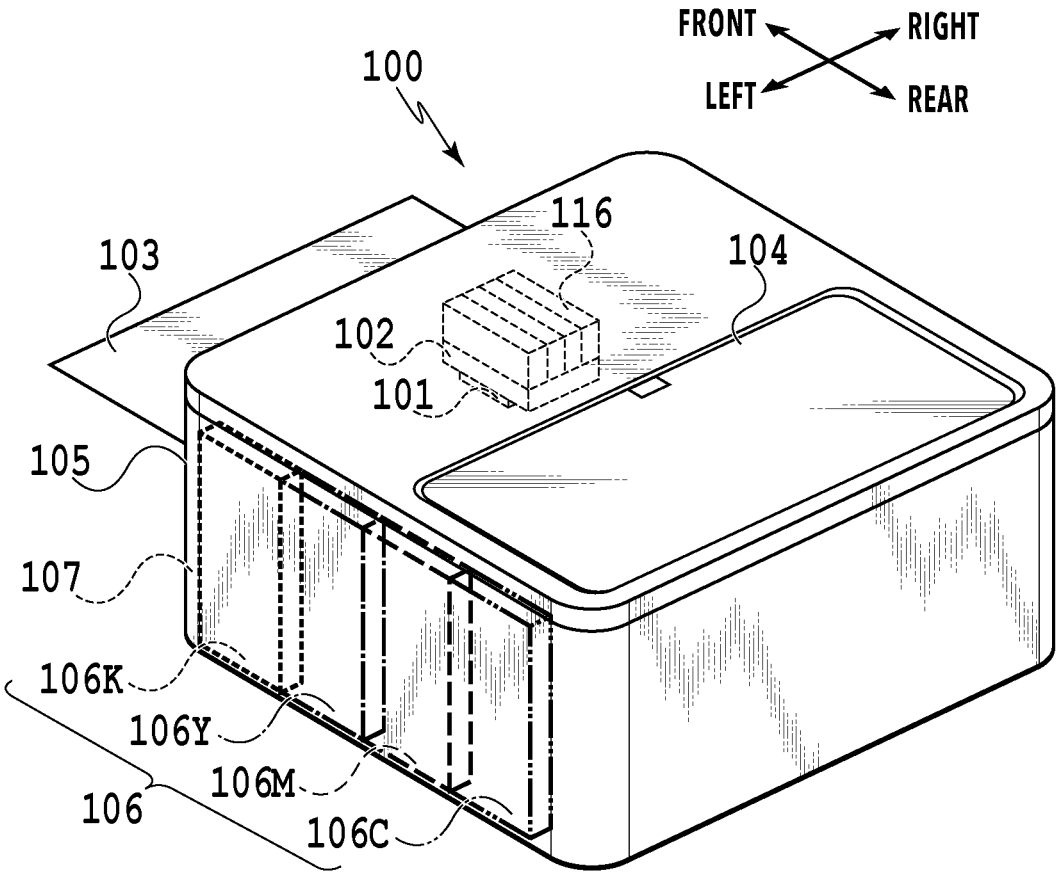
FIG. 4 is a perspective view of a liquid ejection apparatus.

FIG. 4 is a diagram showing a structure in which all the ink tanks 106 are gathered at the housing wall 107 of a left side surface of the housing 105. Although an example of fixing all the ink tanks 106 to the housing wall 107 will be described herein, it is not always necessary to fix all the ink tanks 106 to the housing wall 107. For instance, only the ink tank (black) 106K that stores the ink used relatively in a large amount and is therefore expected to have a larger capacity may be fixed to the housing wall 107.

Figure 5C:
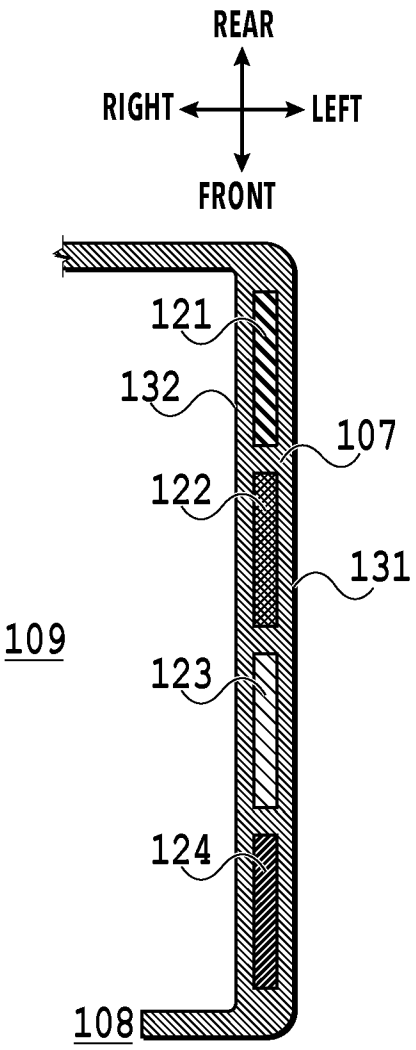
FIGS. 5A to 5C are cross-sectional views of the liquid ejection apparatus.
Figure 5B:
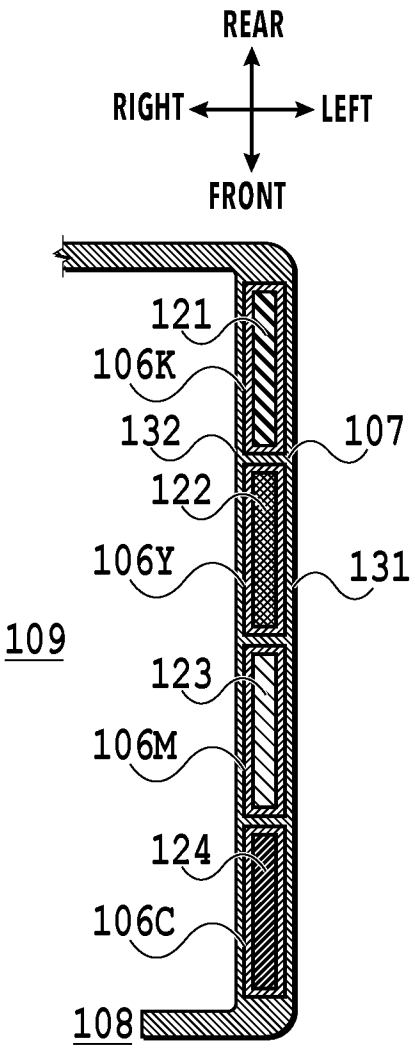
Figure 5A:
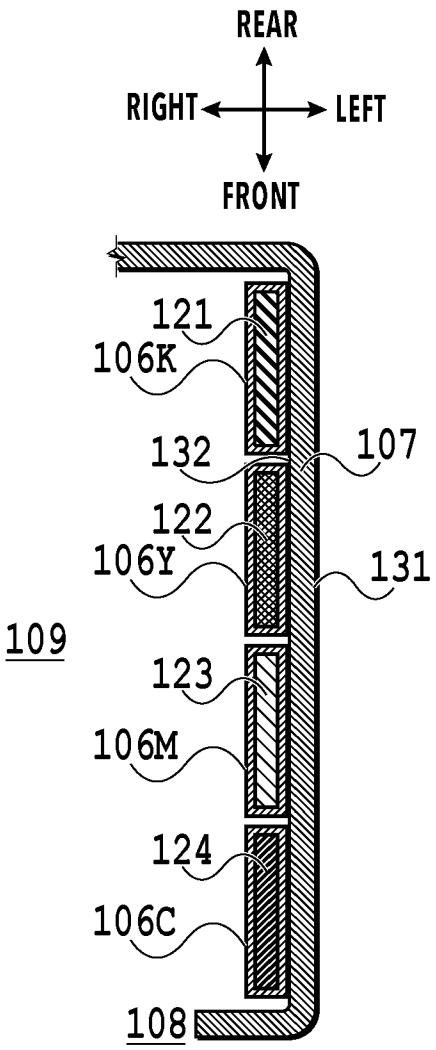

FIGS. 5A to 5C are diagrams to explain detailed structures of the housing wall 107 and the ink tanks 106. FIGS. 5A to 5C show cross-sectional views taken in a direction of a horizontal plane of the ink tanks 106 and the housing wall 107 of the liquid ejection apparatus 100 in FIG. 4. As one example, FIG. 5A discloses a structure in which the ink tanks 106 are fixed to the housing inner wall surface 132 of the housing wall 107. The ink tanks 106 are exposed to the internal space 109 of the housing 105. Meanwhile, the housing outer wall surface 131 is exposed to the outside of the liquid ejection apparatus 100.

The ink tanks 106 of this example extend in a direction parallel to the housing wall 107, and have an aspect ratio that reduces the thickness direction of the housing wall 107. Such an ink tank 106 to prone to fall over and is therefore hard to stabilize its position. This is why the ink tanks 106 are fixed to the housing wall 107 in this embodiment. Thus, the positions of the ink tanks 106 are stabilized so that the occurrence of ink leakages from joints of the ink tubes associated with the movement of the ink tanks 106 can be suppressed. Though FIG. 5A shows an example in which the housing wall 107 has a single layer structure, the housing wall 107 may have a multilayer structure instead.

As for a method of fixing the ink tanks 106 to the housing inner wall surface 132, joints that enable fixation of fixing jigs are provided to part of components of the ink tanks 106 or to part of the housing inner wall surface 132 so that the ink tanks 106 can be fixed to the housing inner wall surface 132 by using the fixing jigs such as screws, swaged parts, and rivets. Instead, the ink tanks 106 may be fixed by sandwiching the ink tanks 106 between a bracket and the housing wall 107 and tightening the bracket. Meanwhile, the ink tanks 106 may be fixed by using an adhesive agent or tapes. Alternatively, the ink tanks 106 may be fixed by providing engagement structures of indented shapes or other interlocking shapes to the ink tanks 106 and the housing inner wall surface 132 and engaging the ink tanks 106 and the housing inner wall surface 132 together.

A material of the housing 105 is preferably a low-cost material with fine moldability. Examples of the material of the housing 105 include polystyrene, polyethylene, acrylonitrile butadiene styrene, polycarbonate, and the like. A material of the ink tanks 106 is preferably a material that has ink resistance and transparency so as to enable visual confirmation of the ink inside. Examples of the material of the ink tanks 106 include polypropylene, polycarbonate, epoxy resin, acrylic resin, and the like.

FIG. 5B is a diagram showing another structural example of the housing wall 107 and the ink tanks 106. As shown in FIG. 5B, the ink tanks 106 may be sandwiched and installed between the housing inner wall surface 132 and the housing outer wall surface 131. In this case, it is possible to install the ink tanks inside the wall in conformity to the shape of the housing wall 107. Thus, the liquid ejection apparatus 100 can be formed smaller as compared to the case in FIG. 5A.

FIG. 5C is a diagram showing still another structural example of the housing wall 107 and the ink tanks 106. As shown in FIG. 5C, if the same material can be shared as the component of the ink tanks 106 and the component of the housing wall 107, then it is possible to further reduce the size, weight, and cost.

As described above, various examples are considered as the structures of the housing wall 107 and the ink tanks 106. FIGS. 5B and 5C show the examples of storing the ink tanks 106 inside the component of the housing wall 107. The examples of FIGS. 5B and 5C are more advantageous than the example of FIG. 5A in light of size reduction. On the other hand, the example of FIG. 5A is more advantageous than the examples of FIGS. 5B and 5C in light of component machining such as ease of molding as well as ease of assembly.

As described above, according to this embodiment, it is possible to downsize the ink-refillable liquid ejection apparatus. Moreover, according to a certain aspect of this embodiment, it is possible to reduce the components of the ink tanks and thus to achieve reduction in weight and cost.

This embodiment has described the example of arranging the four ink tanks 106 in or on the housing wall or walls 107. However, at least one ink tank 106 needs to be arranged in or on the housing wall 107, or five or more ink tanks 106 may be arranged in or on the housing wall or walls 107.

Second Embodiment

This embodiment will describe details of an example in which all the ink tanks 106 are intensively arranged on the housing wall 107 of an arbitrary surface of the housing 105. This embodiment will explain the example of gathering all the ink tanks 106 to the left side surface of the housing 105 as with the case described with reference to FIG. 4.

FIGS. 6A to 6D are diagrams showing details of the housing wall 107 and the ink tanks 106 of this embodiment. Each of FIGS. 6A to 6D is a diagram viewed from the inside of the housing 105, which illustrates the housing wall 107 on which the ink tanks 106 are arranged.

Figure 6A:
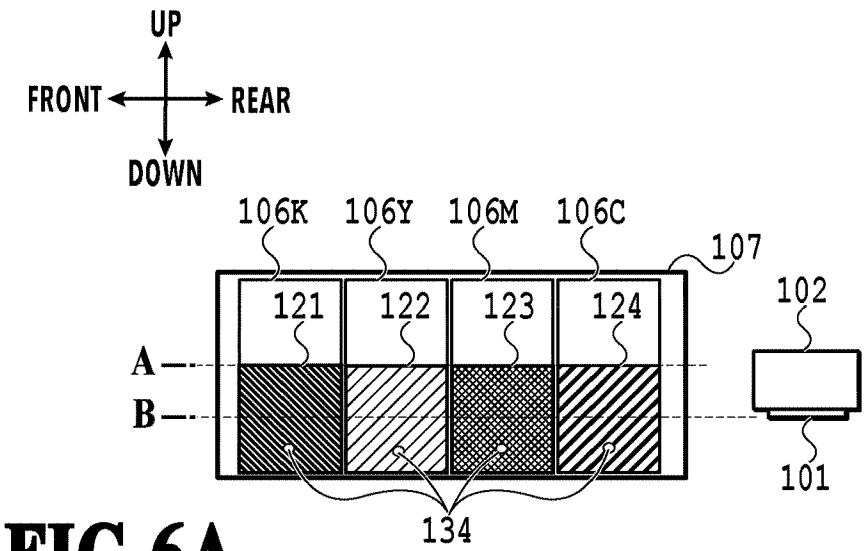
FIGS. 6A to 6D are diagrams showing details of a housing wall and ink tanks.

As shown in FIG. 6A, for example, all the ink tanks 106 are gathered and arranged on an arbitrary surface of the housing 105. This makes it easier to gather ink discharge holes 134, which are holes to discharge the inks from the ink tanks 106 to the liquid ejection head 101, at portions of the ink tanks 106 close to one another. Thus, it is possible to gather the ink tubes to be connected to the ink discharge holes 134 of the respective ink tanks 106. As a consequence, the moving range of the ink tubes in the internal space 109 of the housing 105 can be reduced, thereby further reducing the size of the liquid ejection apparatus 100.

Another advantage of this configuration is ease of sharing components with the existing printer because only the arbitrary one surface of the housing 105 needs to be replaced with the housing wall 107 provided with the ink tanks. It is thus possible to reduce the cost. Moreover, it is easier to gather the ink filling ports 136 (see FIGS. 7A to 7C to be described later), which are ports used for refilling the ink tanks 106 with the inks, at portions of the respective ink tank 106 close to one another.

Next, preferable structures of the ink tanks will be described from the viewpoint of the supply of inks from the ink tanks 106 to the liquid ejection head 101. As discussed earlier, in FIG. 6A, all the ink tanks 106 are gathered on the housing wall 107 of the left side surface of the housing 105. The ink tank 106K is filled with a black ink 121. The ink tank 106Y is filled with a yellow ink 122. The ink tank 106M is filled with a magenta ink 123. The ink tank 106C is filled with a cyan ink 124.

Figure 6B:
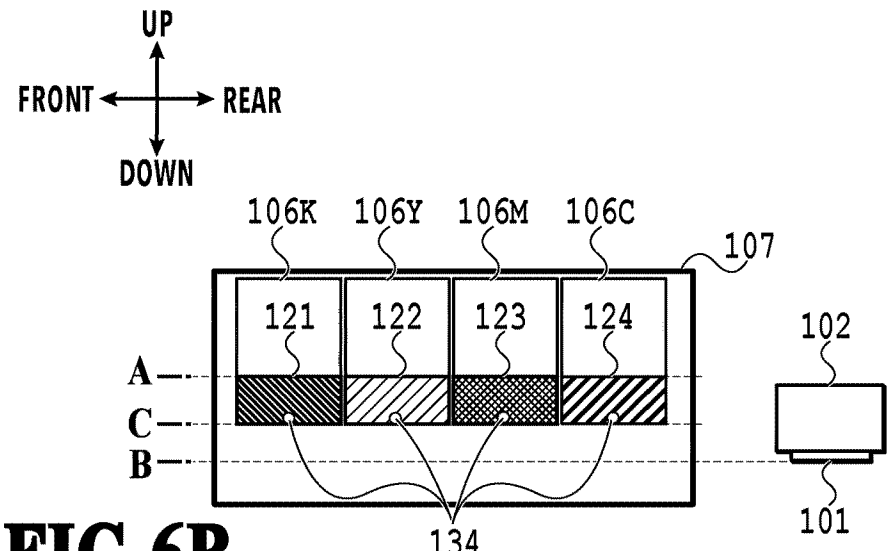

In a case of supplying the ink by using a water head difference, the ink is hardly supplied to the liquid ejection head 101 side unless an ink upper surface (indicated with a dashed line A) inside each ink tank 106 is at least higher than a height of an ejection surface (indicated with a dashed line B) of the liquid ejection head 101 as shown in FIG. 6A. Moreover, as shown in FIG. 6B, in order to use up the ink until the ink tank 106 becomes empty, it is preferable to set a height of the lowermost portion of each ink tank 106 and a height of each ink discharge hole 134 (indicated with a dashed line C) above a height of the liquid ejection head 101.

Figure 6C:
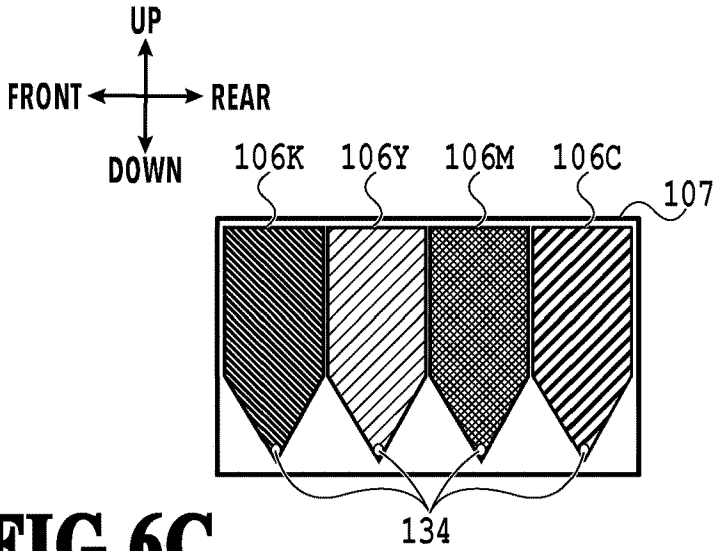
Figure 6D:
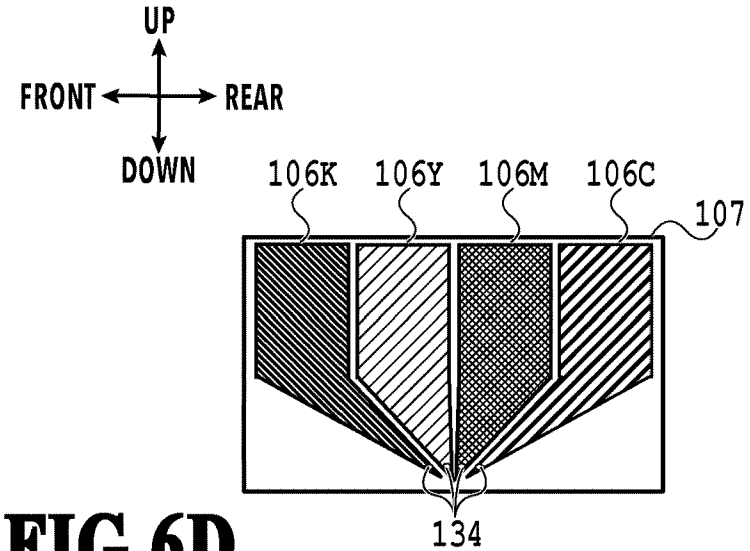

Meanwhile, in order to improve a discharge performance of the ink inside each ink tank 106, it is preferable to form an inclination toward the ink discharge hole 134 by reducing a width of the ink tank 106 gradually toward the ink discharge hole 134 as shown in FIG. 6C. Thus, the ink is more likely to gather at the ink discharge hole 134. In addition, it is easier to gather the ink tubes by gathering the ink discharge holes 134 close to one another as shown in FIG. 6D. This configuration is preferable in light of size reduction.

Figure 7B:
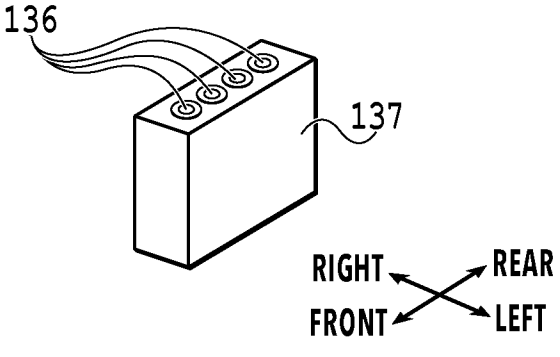
FIGS. 7A to 7C are diagrams showing relations among the ink tanks, the housing wall, and ink filling ports.
Figure 7A:
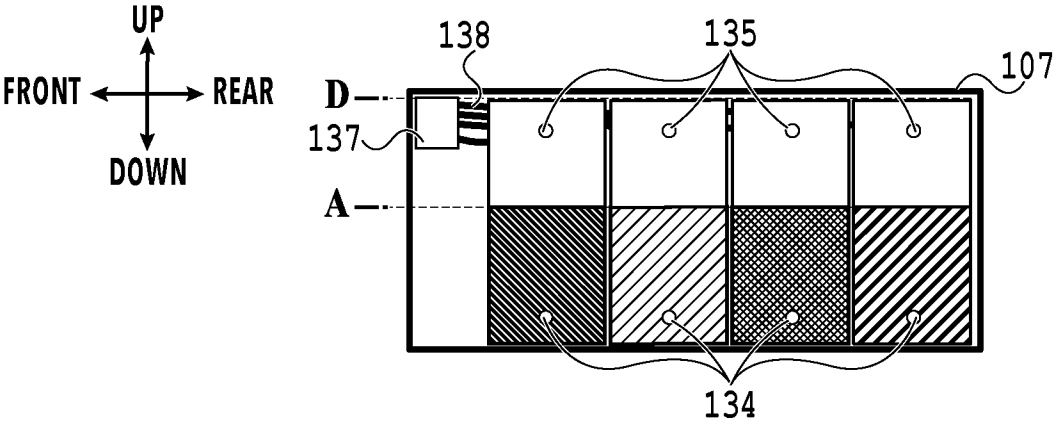
Figure 7C:
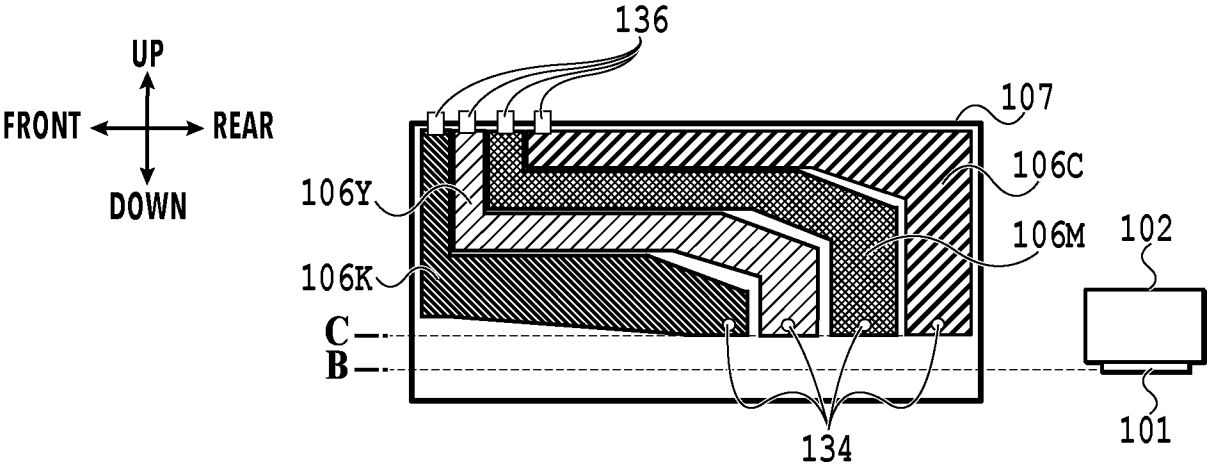

FIGS. 7A to 7C are diagrams showing relations among the ink tanks 106, the housing wall 107, and the ink filling ports 136. Each ink tank 106 is provided with the ink filling port 136 into which an ink bottle filled with an ink for refilling is to be inserted. From the viewpoint of user accessibility, these ink filling ports 136 are preferably gathered at a portion (such as a front surface) of the liquid ejection apparatus. For example, as shown in FIG. 7A, an ink filling jig 137 for inserting the ink bottles may be installed at a front part of the liquid ejection apparatus 100 as shown in FIG. 7A, and the ink filling jig 137 may be connected to ink supply holes 135 of the ink tanks 106 by using flexible tubes such as ink tubes 138.

FIG. 7B shows a perspective view of an example of the ink filling jig 137. The ink filling ports 136 for the black, yellow, magenta, and cyan inks are intensively arranged on an upper surface of the ink filling jig 137. A user can insert an opening of the ink bottle containing the ink into the corresponding ink filling port 136 and pour the ink therethrough.

FIG. 7C is a diagram showing an example which does not use the ink filling jig 137 or the ink tubes 138 mentioned above. Specifically, it is possible to gather the ink filling ports 136 to a front part of the liquid ejection apparatus 100 by forming the ink tanks 106 into prescribed shapes instead of using the ink filling jig 137 and the ink tubes 138. As shown in FIG. 7C, it is preferable to set the height of the lowermost portion of each ink tank 106 and the height of each ink discharge hole 134 (indicated with the dashed line C) above the height of the liquid ejection head 101 (indicated with the dashed line B) in the direction of gravitational force from the viewpoint of maintaining the water head difference. Accordingly, it is preferable to locate the ink tanks 106 in an upper region of the housing wall 107. In addition, the ink tanks 106 are formed into prescribed shapes in order to arrange the ink filling ports 136 of all the ink tanks 106 at the front part of the liquid ejection apparatus 100. Specifically, as shown in FIG. 7C, the ink tanks 106 have elongate shapes that extend in one direction. Each of the ink tanks 106 is formed substantially into an L-shape, and at least a certain ink tank 106 is formed substantially into an inverted L-shape. To be more precise, the ink tank 106K and the ink tank 106C are each formed substantially into an L-shape and are oriented to directions that are not parallel to each other. Each of the ink tank 106Y and the ink tank 106M includes a shape that combines the ink tank 106K and the ink tank 106C. Note that the explanations herein are focused only on the shapes but not on the sizes thereof. As mentioned above, at least one of the ink tanks 106 preferably has such a shape that is formed by joining ends of two ink tanks having elongate shapes extending in one direction to each other while orienting the ink tanks in directions not parallel to each other. In this way, it is possible to effectively use the housing wall 107 on which the ink tanks 106 are arranged as shown in FIG. 7C. To be more precise, it is possible to gather the respective ink tanks 106 on the arbitrary housing wall 107, to gather the ink filling ports 136 at the front part of the liquid ejection apparatus 100 without using flexible tubes such as the ink tubes 138, and to maintain differences in capacity among the ink tanks 106 within a predetermined range. Here, an angle of junction (crossing) of the shapes of two ink tanks 106K and 106C that form the shape of the one ink tanks 106Y or 106M may be set equal to 90°, above 90°, or below 90°.

Figure 8:
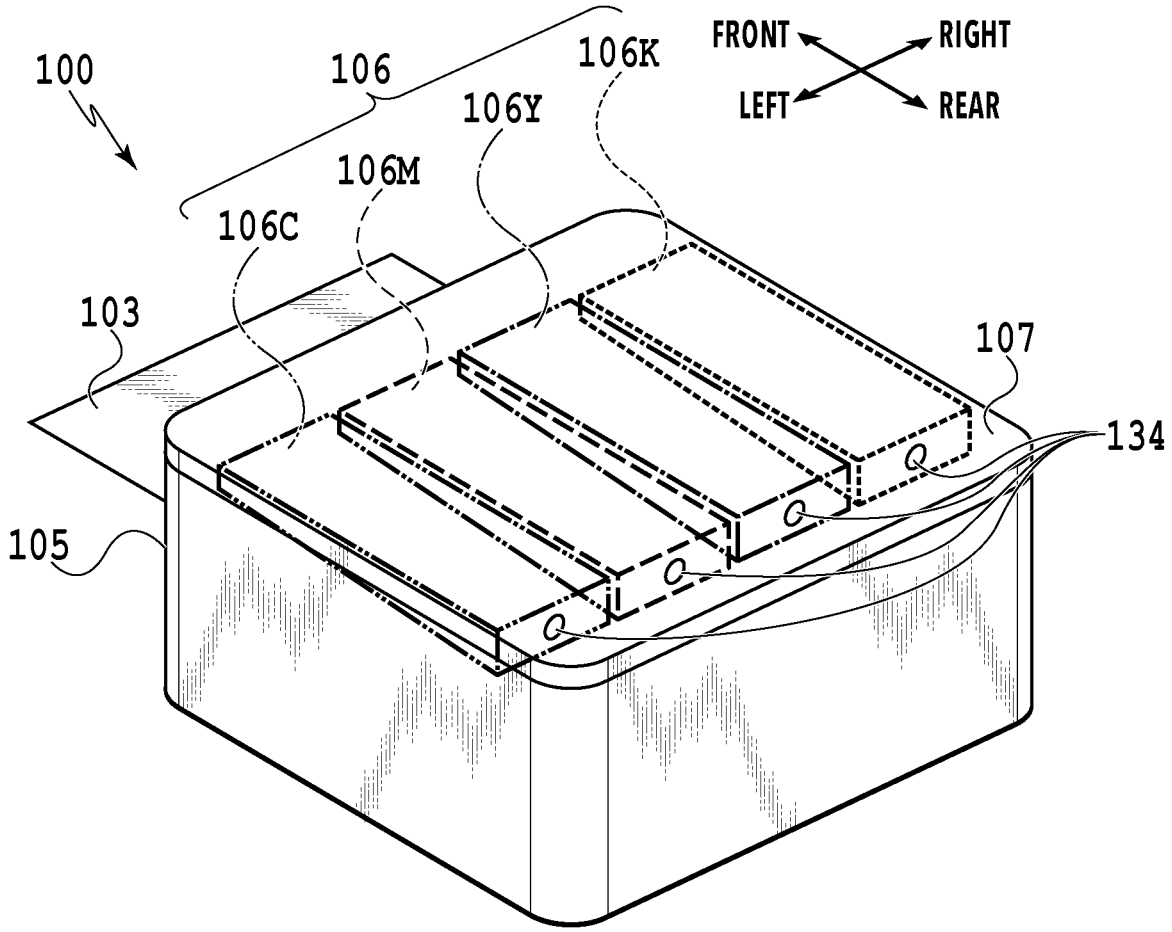
FIG. 8 is a perspective view of a liquid ejection apparatus.

FIG. 8 is a perspective view sowing another example of arranging the ink tanks 106 on a wall of the housing 105. The liquid ejection apparatus 100 in FIG. 8 is an apparatus provided only with a printing function. In order to further stabilize the water head difference between each ink tank 106 and the liquid ejection head 101, it is preferable to gather all the ink tanks 106 to the housing wall 107 on an upper surface of the housing 105 of the liquid ejection apparatus as shown in FIG. 8. In this case, each ink tank 106 is arranged above the liquid ejection head 101 and its water head difference is constant irrespective of a remaining amount of the ink therein.

Meanwhile, as shown in the example of the ink tanks 106 in FIG. 8, it is preferable to incline a bottom surface of each ink tank 106 such that the height of the ink discharge hole 134 becomes the lowest so as to improve the discharge performance of the ink.

Note that the configuration to gather the ink tanks 106 on the upper surface of the housing 105 is not limited only to the liquid ejection apparatus provided only with the printing function as illustrated in FIG. 8. This configuration is also applicable to a liquid ejection apparatus that functions as a multifunction peripheral equipped with a scanner unit. In the case of the liquid ejection apparatus provided with the scanner unit on the upper surface of the housing 105, for example, the ink tanks 106 may be installed by using a frame below the scanner unit as the housing wall.

While this embodiment has discussed the example of using the water head difference as the means for supplying the ink from each ink tank 106 to the liquid ejection head 101, other measures such as pumps may be used instead. Since the inks can be supplied more easily in the case of using the pumps, it is possible to ease restrictions on the water head difference which are discussed in this embodiment.

Figure 9B:
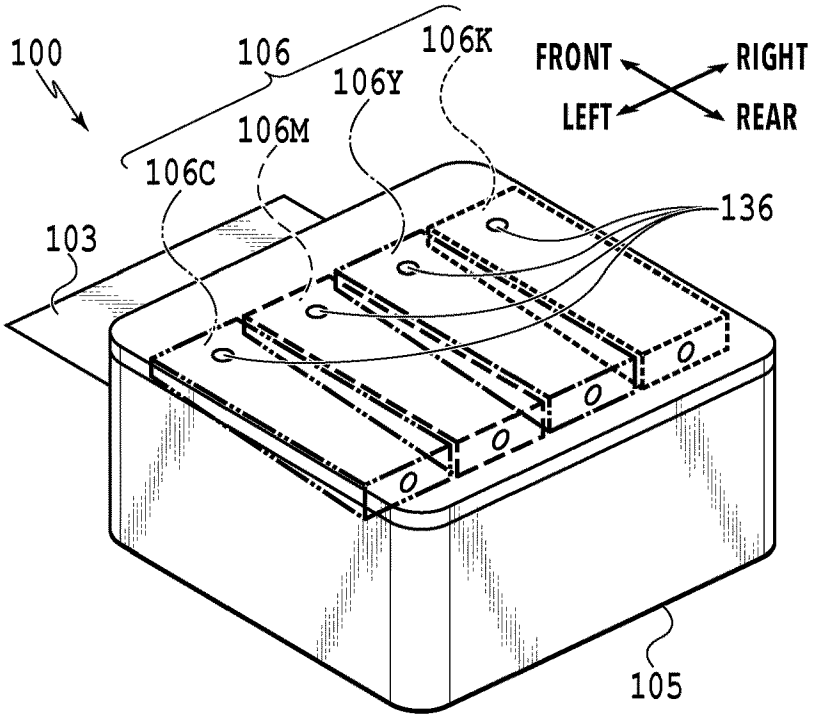
FIGS. 9A and 9B are perspective views of liquid ejection apparatuses.
Figure 9A:
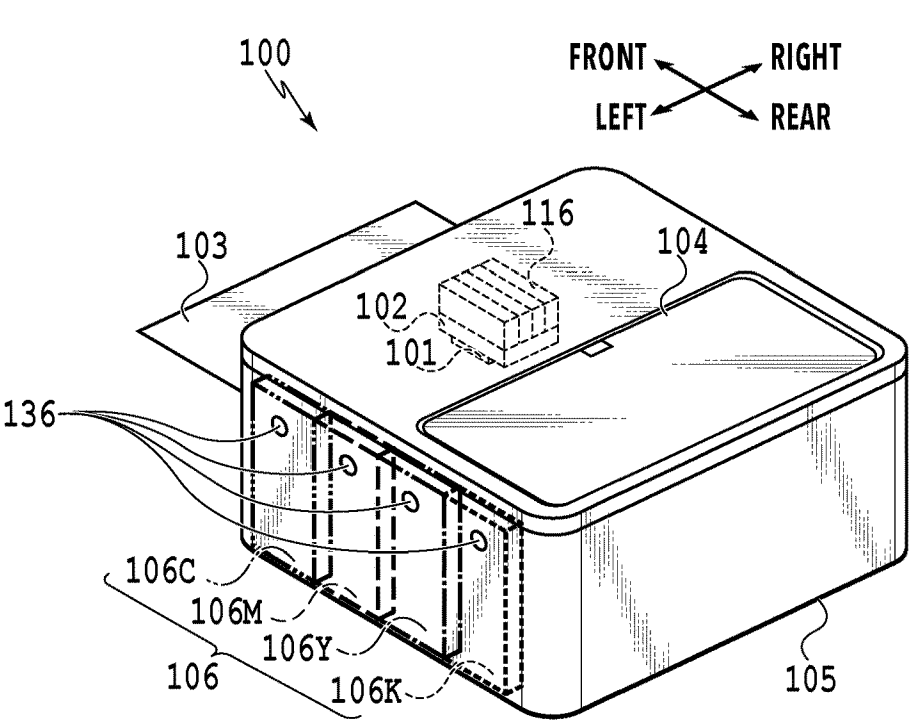

FIGS. 9A and 9B are perspective views showing an example of providing the ink filling ports 136 on the housing outer wall surface 131. Accessibility to the ink filling ports 136 can be improved by providing the ink filling ports 136 directly on the housing outer wall surface 131. In this embodiment, the ink filling ports 136 are formed on the housing outer wall surface 131. Meanwhile, the ink tanks 106 are arranged just behind the portion of the housing outer wall surface 131 where the ink filling ports 136 are formed. Each ink tank 106 is provided with an ink supply hole, and this ink supply hole is configured to communicate with the ink filling port 136 located at an opposite position thereto. In this way, it is possible to refill the ink tank 106 with the ink directly from outside. FIG. 9A shows an example of providing the ink filling ports 136 on the side surface of the housing 105 while FIG. 9B shows an example of providing the ink filling ports 136 on the upper surface of the housing 105. Provision of the ink filling ports 136 on the housing outer wall surface 131 saves the space inside the housing 105 for installing the ink filling ports 136 and the ink filling jig 137. As a consequence, it is possible to further downsize the apparatus.

As described above, according to this embodiment, it is possible to downsize the apparatus by gathering the ink tanks 106 on the housing wall 107 of a certain surface of the housing 105. Meanwhile, by gathering the ink tanks 106 on the certain surface, it is easier to gather the ink tubes for connecting the ink tanks 106 to the liquid ejection head 101. Thus, it is possible to further downsize the apparatus. Moreover, it is possible to gather the ink filling ports 136 used for filling the ink tanks 106 with the inks at a prescribed position without disturbing the space inside the housing 105. Thus, it is also possible to improve user accessibility.

Meanwhile, in this embodiment, the ink tanks 106 may be arranged between the housing inner wall surface 132 and the housing outer wall surface 131 or integrated with the housing wall 107 as described with reference to FIGS. 5A to 5C in the first embodiment.

Third Embodiment

This embodiment will describe details of an example in which the housing wall 107 to which the ink tanks 106 are fixed is a fixed and immovable wall. If the housing wall 107 to which the ink tanks 106 are fixed is a wall such as a movable cover, then the ink tanks 106 are also movable along with the movement of this wall. In this case, joining portions of the ink tubes with the ink supply holes 135 and the ink discharge holes 134 may be pulled and damaged, thus possibly causing ink leakages and the like. The occurrence of the ink leakages and the like can be suppressed by fixing the ink tanks 106 to the fixed and immovable housing wall 107.

FIG. 2 that has been explained in the first embodiment represents the example in which the ink tanks 106 are fixed to the fixed and immovable housing wall 107. This embodiment will be described with reference to FIG. 2 again. A front surface of the housing 105 is a surface provided with the paper discharge tray 103 (a paper discharging port 108). In the example of FIG. 2, the fixed and immovable housing walls 107 are located on the right and left side surfaces of the housing 105 as well as the rear surface of the housing 105. Accordingly, the ink tanks 106 are arranged on the left side surface and on the rear surface of the housing 105 in FIG. 2.

By arranging the ink tanks 106 on the fixed and immovable housing walls 107 as described above, it is also possible to use the ink tanks 106 as components for reinforcing the housing 105. An improvement in strength of the housing can reduce the thickness of the housing 105. Meanwhile, a reinforcing member previously used for reinforcing the housing 105 can also be curtailed. As a consequence, it is possible to reduce the weight and the cost of the liquid ejection apparatus 100.

Figure 10A:
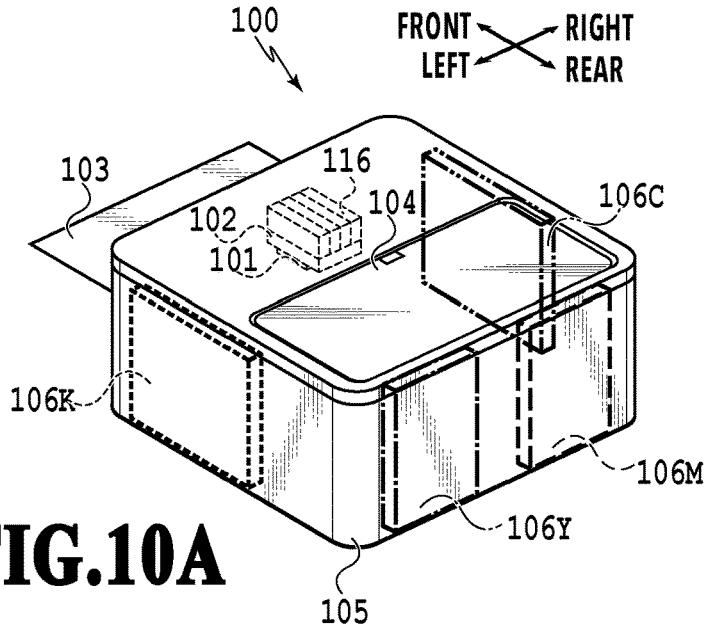
FIGS. 10A to 10C are perspective views of liquid ejection apparatuses.
Figure 10B:
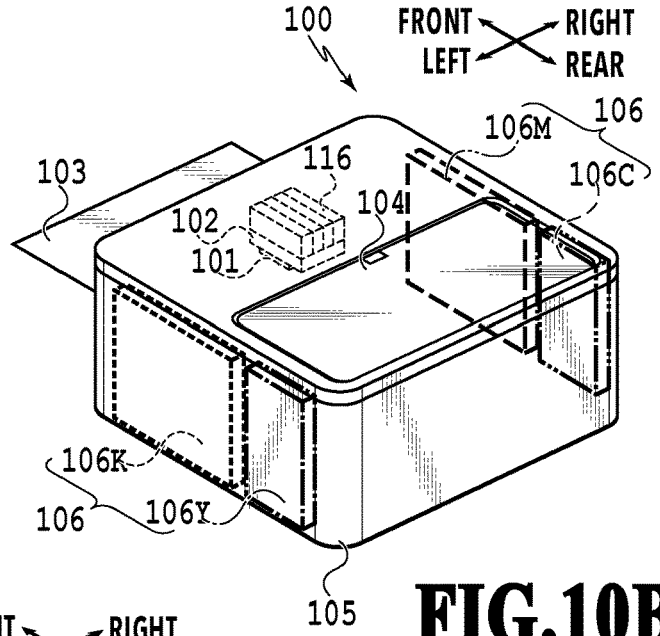
Figure 10C:
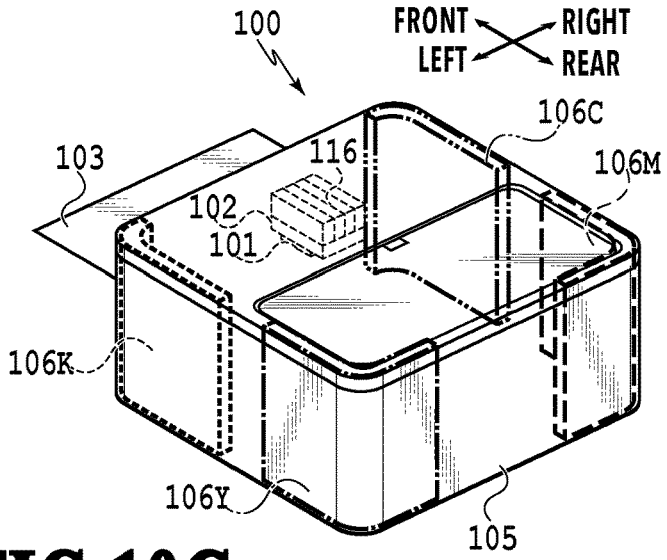

FIGS. 10A to 10C are perspective views to explain examples of reinforcing the housing 105 with the ink tanks 106. In order to reinforce the housing 105, it is preferable to arrange the ink tanks 106 on the walls of the housing 105 other than any movable walls. To be more precise, it is preferable to arrange the ink tanks 106 on the right and left side surfaces and the rear surfaces of the housing 105 as shown in FIG. 10A. On the other hand, the ink tanks 106 may be provided only on the right and left side surfaces of the housing 105 as shown in FIG. 10B. Such reinforcement of two surfaces opposed to each other (which are the right and left side surfaces in this example) of the housing 105 is effective for supporting the housing 105.

In the meantime, the ink tanks 106 may be arranged on all corner portions of the side surfaces of the housing 105 as shown in FIG. 10C, because the corner portions of the housing are likely to develop stress concentrations and are thus prone to lose the strength. In the case of arranging the ink tanks 106 at the corner portions of the side surfaces of the housing 105, it is preferable in light of improvement in strength to form the shape of each ink tank 106 into such a shape that extends across two housing surfaces as shown in FIG. 10C. Otherwise, a cylindrical body having an arbitrary cross-sectional shape and a longitudinal direction, such as a rectangular parallelepiped, an elliptical cylinder, and a long circular cylinder may be arranged at each corner portion. In the meantime, such cylindrical bodies may be provided in such a way as to cross each other at a corner portion.

As described above, according to this embodiment, it is possible to downsize the liquid ejection apparatus 100 and to suppress ink leakages by fixing the ink tanks 106 to the fixed and immovable housing walls 107. In addition, it is possible to use the ink tanks 106 as the components for reinforcing the housing 105.

Modified Examples

Next, various modified examples will be described with reference to the drawings.

Figure 11A:
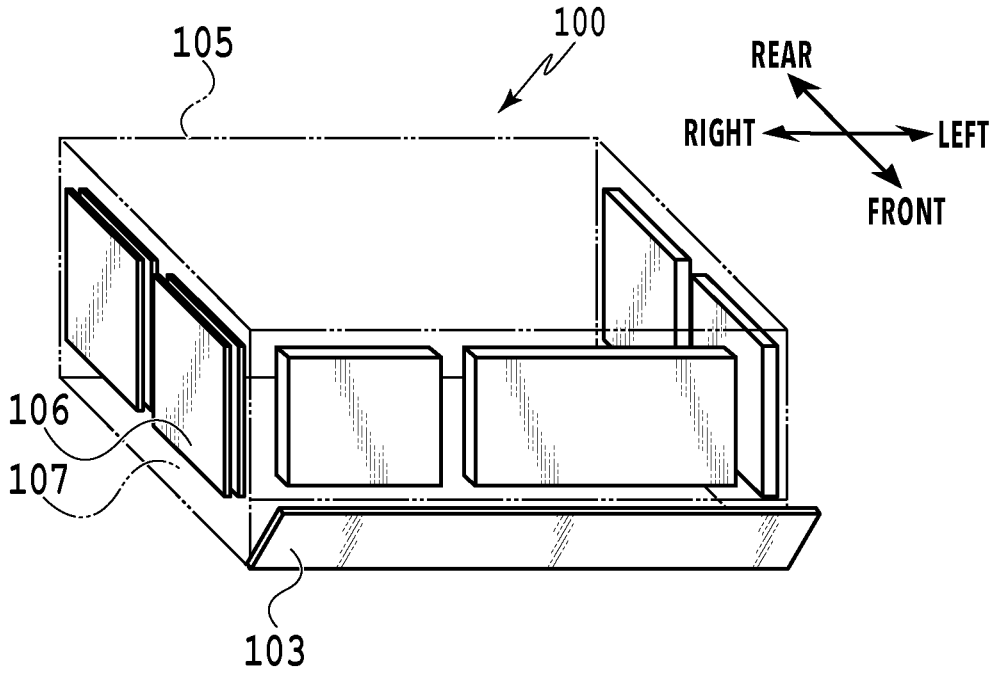
FIGS. 11A and 11B are diagrams showing an example of disposing ink tanks on inner walls of surfaces of a housing.
Figure 11B:
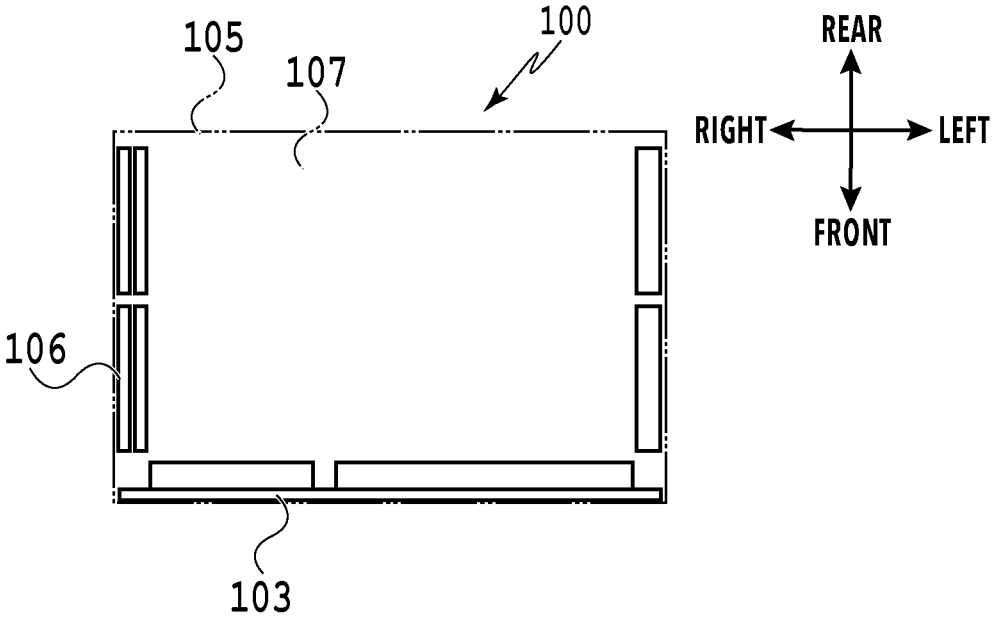

FIGS. 11A and 11B are diagrams showing an example of arranging multiple ink tanks on inner walls of multiple surfaces of the housing 105. As with the example described in conjunction with the first embodiment, independent ink tanks are arranged on the inner walls of the surfaces of the housing 105 in FIGS. 11A and 11B. To be more precise, FIGS. 11A and 11B show an example of arranging eight ink tanks 106 on the inner walls of the housing 105. Meanwhile, in FIGS. 11A and 11B, multiple ink tanks 106 are stacked on the housing wall 107 on the right side of the housing 105 (which is the left side on the plane of paper). As illustrated therein, by stacking two ink tanks 106 each having a width half as large as the thickness of other ink tanks 106, it is possible to increase the number of colors of inks without an increase in consumption of the space inside the housing. Moreover, in the example of FIGS. 11A and 11B, the paper discharge tray 103 is provided at a lower part of the front surface of the housing, so that the ink tanks 106 can be arranged at an upper part of the front surface.

Figure 12A:
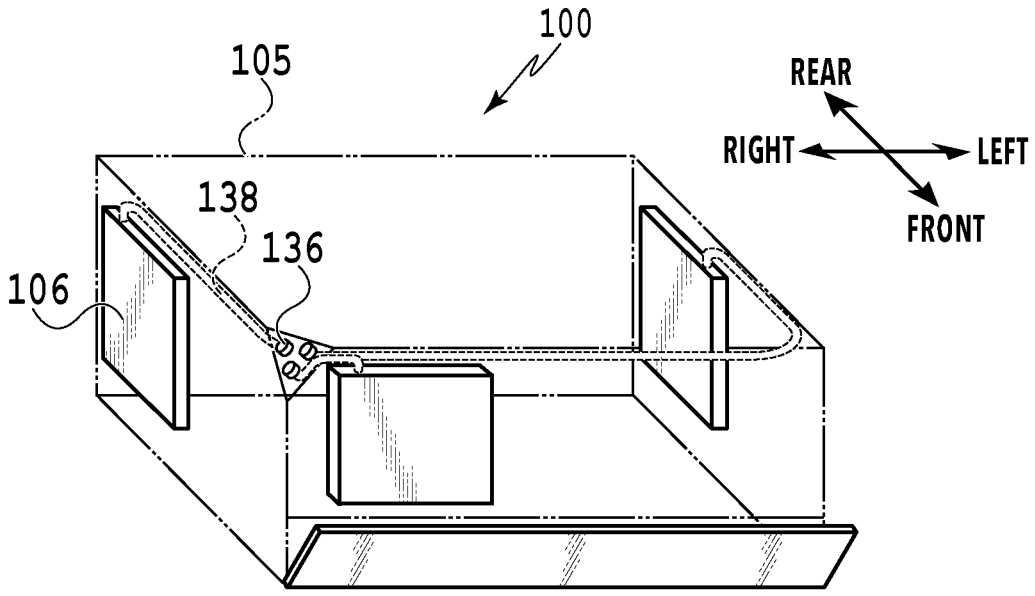
FIGS. 12A and 12B are diagrams to explain locations of ink filling ports.
Figure 12B:
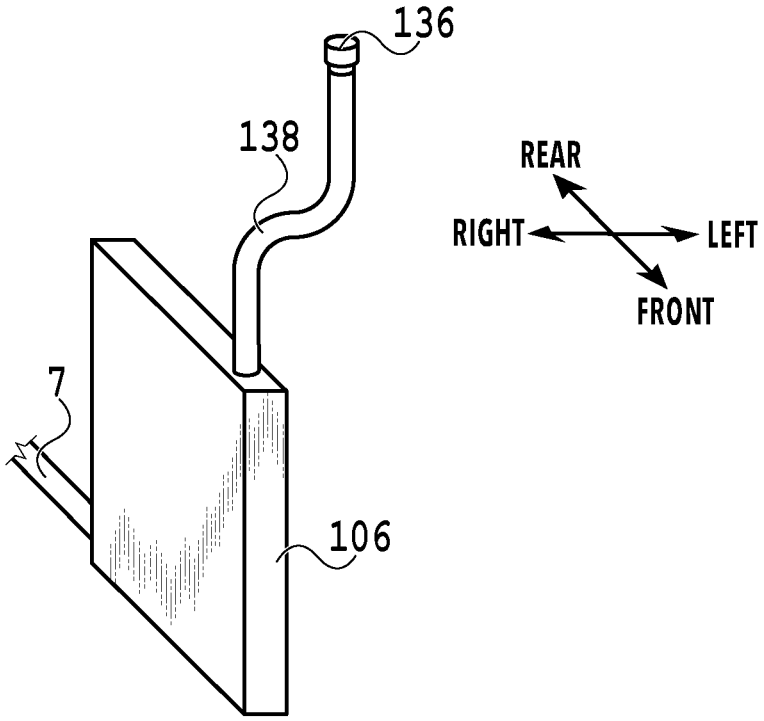

FIGS. 12A and 12B are diagrams to explain locations of the ink filling ports 136. FIG. 12A is a schematic perspective view of the liquid ejection apparatus 100 and FIG. 12B is an enlarged view of one of the ink tanks 106. As described in the second embodiment, the user can easily access the ink filling ports 136 at the time of pouring the inks by gathering the ink filling ports 136 at a prescribed position of the housing 105. The ink in each ink tank 106 is sent to the liquid ejection head 101 (not illustrated in FIGS. 12A and 12B) through a tube 7. In FIG. 12A the ink tanks 106 are arranged on multiple surfaces of the housing 105 unlike the example described in the second embodiment.

The ink tanks 106 are provided with the ink filling ports 136 used for the refill with the inks, which are open via the ink tubes 138. It is preferable to gather these ink filling ports 136 at one position operable from the outside of the housing 105. In this way, it is possible to wipe off the liquids that adhere during the ink filling easily without cumbersome processes, and maintainability of the liquid ejection apparatus is thus improved.

Figure 13A:
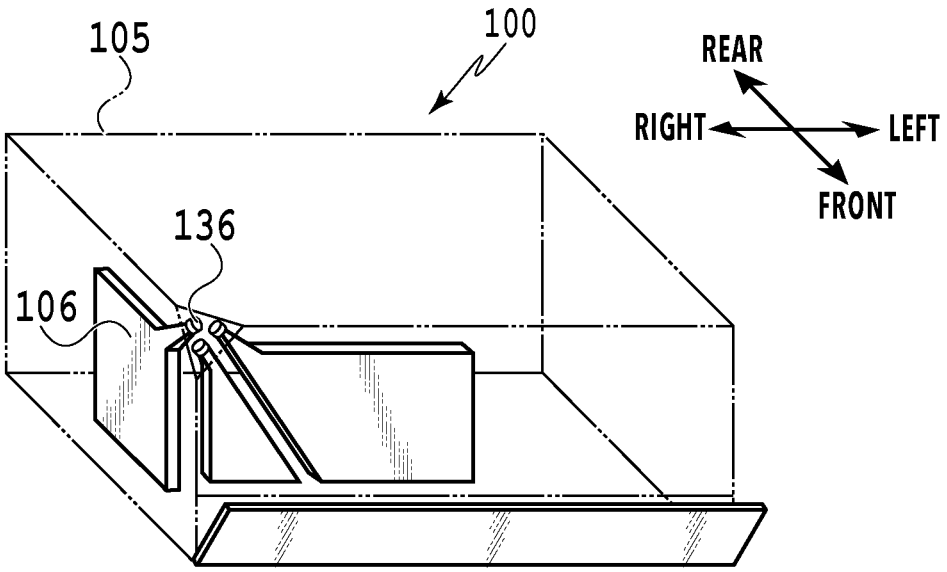
FIGS. 13A and 13B are diagrams to explain locations of ink filling ports.
Figure 13B:
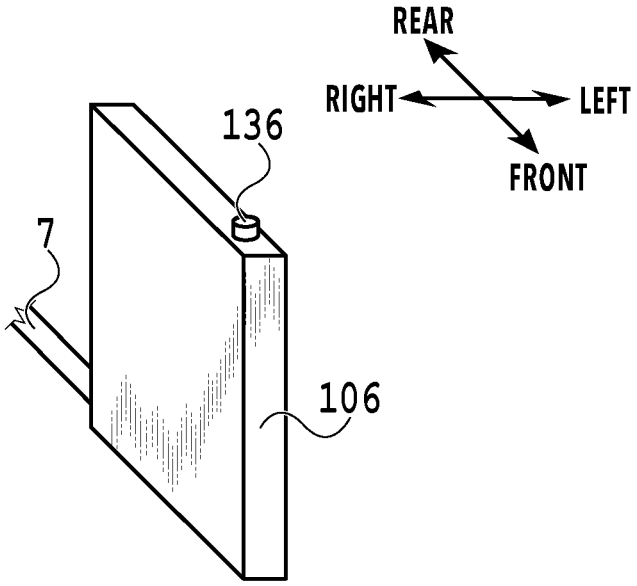

FIGS. 13A and 13B are more diagrams to explain locations of the ink filling ports 136. FIG. 13A is a schematic perspective view of the liquid ejection apparatus 100 and FIG. 13B is an enlarged view of one of the ink tanks 106. FIGS. 13A and 13B represent an example which does not involve the ink tubes 138. Unlike the example described in the second embodiment, the ink tanks 106 are arranged on multiple surfaces of the housing 105 as shown in FIG. 13A.

The ink filling ports 136 are open directly on the ink tanks 106 without providing any ink tubes 138. In this case, the shapes of the respective ink tanks 106 and the ink filling ports 136 are designed such that the ink filling ports 136 of the respective ink tanks are gathered at one position. In the case of providing no ink tubes 138, it is possible to avoid trouble such as liquid leakages and thus to provide a more reliable liquid ejection apparatus 100. In addition, it is possible to achieve an effect of reduction in weight of the liquid ejection apparatus 100 as a consequence of reduction in the number of components.

Figure 14A:
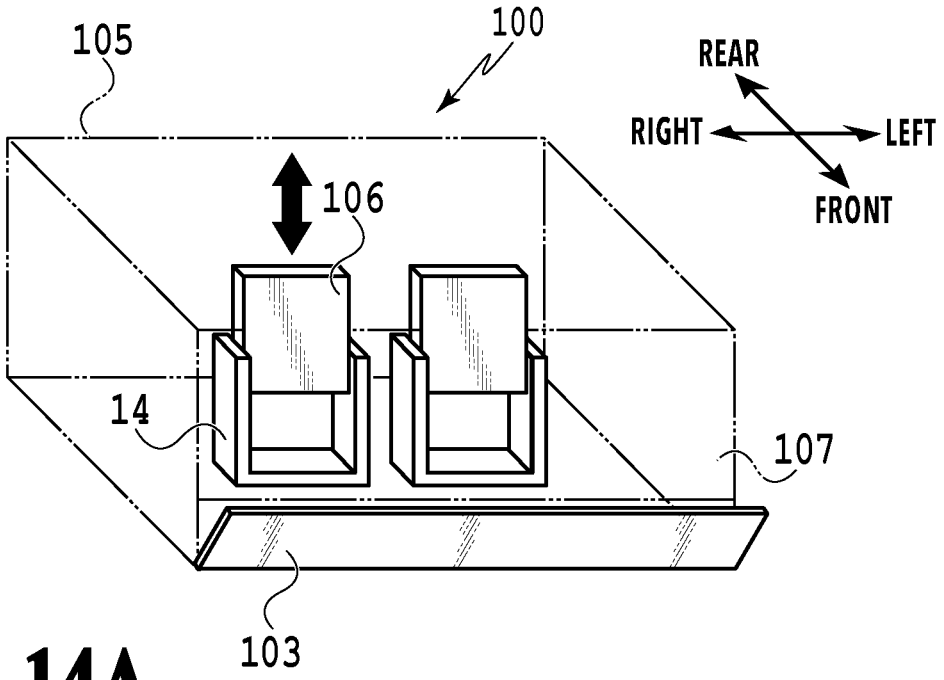
FIGS. 14A and 14B are diagrams to explain detachable ink tanks.
Figure 14B:
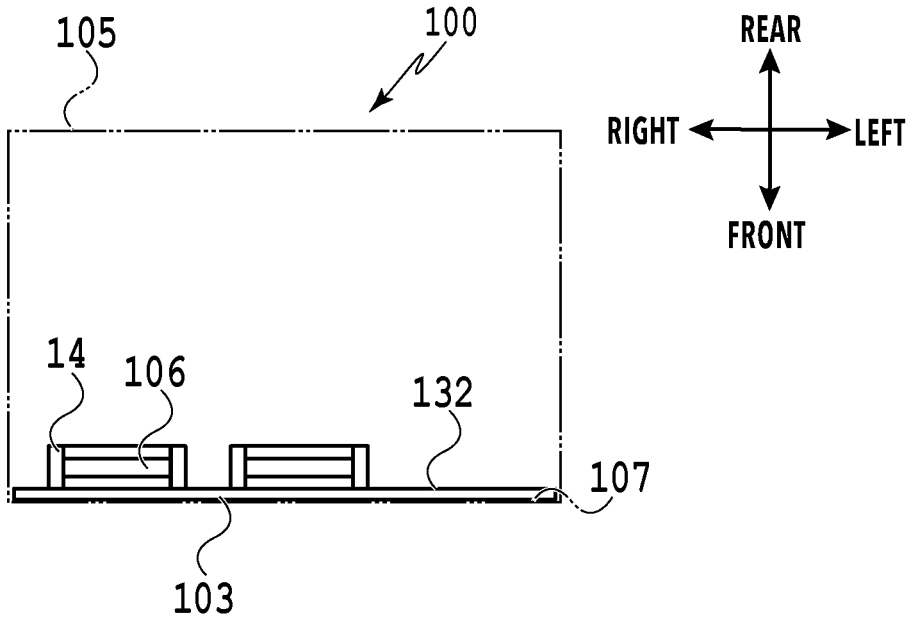

FIGS. 14A and 14B are diagrams to explain detachable ink tanks 106. The ink tanks 106 are provided to the housing wall 107, and are independently attachable to and detachable from the housing wall 107. Though the ink tanks 106 may be held in various ways, the ink tanks 106 may be fitted into and held by cassettes 14 that are attached to the housing inner wall surface 132 in the housing, for example. This configuration makes it possible to clean or repair only the necessary part in case of adhesion of ink components to the inside of one of the ink tanks 106 or in case of a breakage of one of the ink tanks 106 on impact, for instance, thereby facilitating the maintenance.

Figure 15:
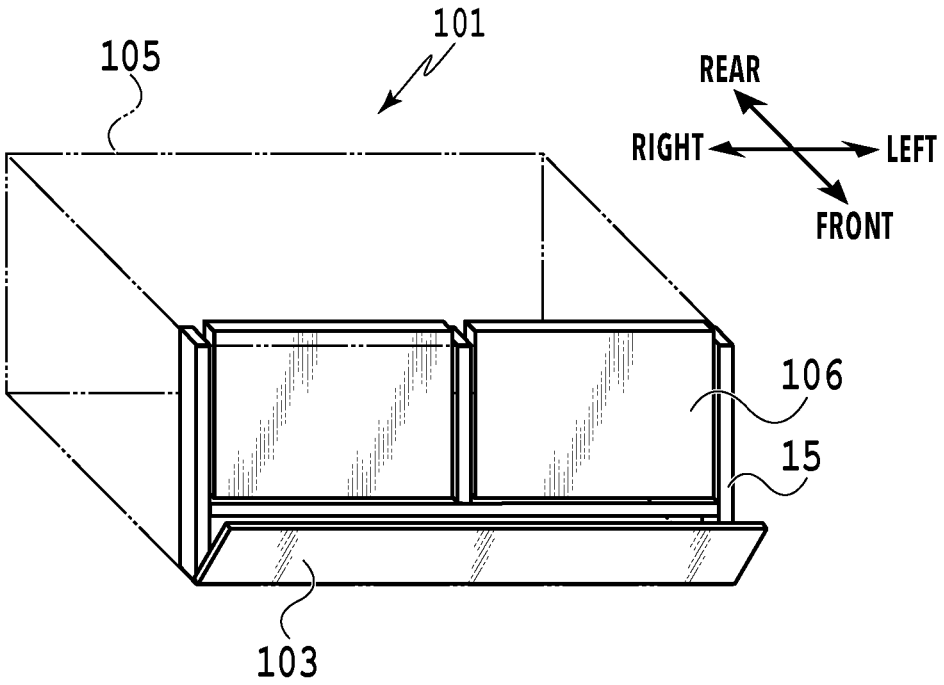
FIG. 15 is a diagram to explain detachable ink tanks.

FIG. 15 is a diagram showing an example in which the ink tanks 106 constituting part of at least one of the housing walls of the housing 105. The ink tanks 106 also serve as the housing 105 of the liquid ejection apparatus 100. Hence, the ink tanks 106 function as the housing 105. For example, a frame 15 is provided at part or all of the housing and the ink tanks 106 are attached into the frame 15. In other words, the frame 15 is configured to establish communication between the inside and the outside of the housing 105 in a state where no ink tanks 106 are attached thereto, and to shut off the communication between the inside and the outside of the housing 105 in a state where the ink tanks 106 are attached thereto. In this way, it is possible to reduce the number of components of the housing 105 and to achieve reduction in weight of the liquid ejection apparatus 100. Moreover, the ink tanks 106 may be formed by using a transparent material so that the liquids inside can be visually checked from outside. As a consequence, visibility of the remaining amount of each liquid is improved. At the same time, this configuration can also create originality in design.

Although each of the examples in FIGS. 14A to 15 has described the case of providing the cassettes 14 or the frame 15 each serving as a tank attachment unit to the housing wall 107 of one of the surfaces, such tank attachment units may be provided to the housing walls 107 of two or more surfaces.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-006648, filed Jan. 20, 2020, which is hereby incorporated by reference wherein in its entirety.

What is claimed is:

1. A liquid ejection apparatus comprising:
at least one ink tank which is ink-refillable from outside;
a liquid ejection head configured to eject an ink supplied from the ink tank; and
a housing configured to contain the ink tank and the liquid ejection head inside, wherein
the at least one ink tank is fixed to a housing wall of at least one surface out of a plurality of surfaces forming the housing, and
of a plurality of surfaces forming the ink tank, a surface attached to the housing wall is any of a surface having the largest area of the ink tank and a surface opposed to the surface having the largest area.

2. The liquid ejection apparatus according to claim 1, wherein
the liquid ejection apparatus includes a plurality of the ink tanks, and
all the ink tanks are fixed to the housing wall.

3. The liquid ejection apparatus according to claim 1, wherein
the housing wall includes:
an inner wall exposed to inside of the liquid ejection apparatus; and
an outer wall exposed to outside of the liquid ejection apparatus, and the ink tank is fixed to the inner wall.

4. The liquid ejection apparatus according to claim 1, wherein
the housing wall includes:
an inner wall exposed to inside of the liquid ejection apparatus; and
an outer wall exposed to outside of the liquid ejection apparatus, and
the ink tank is fixed between the inner wall and the outer wall.

5. The liquid ejection apparatus according to claim 1, wherein the ink tank and the housing wall are formed from an integrated component.

6. The liquid ejection apparatus according to claim 1, wherein
the housing includes a movable wall provided to at least one of surfaces forming the housing, and
the housing wall to which the ink tank is fixed is a wall of at least one of the surfaces except the surface provided with the movable wall.

7. The liquid ejection apparatus according to claim 1, wherein
the at least one ink tank is arranged at one of corner portions of side surfaces of the housing and is fixed across respective housing walls of two surfaces forming the corner portion.

8. The liquid ejection apparatus according to claim 1, wherein
the liquid ejection apparatus includes a plurality of the ink tanks, and
any of the plurality of the ink tanks is fixed to each of a plurality of housing walls of surfaces forming side walls of the housing except a surface from which a print medium printed by the liquid ejection head is discharged.

9. The liquid ejection apparatus according to claim 1, wherein
the liquid ejection apparatus includes a plurality of the ink tanks, and
all of the plurality of ink tanks are fixed to a housing wall of an arbitrary one of the plurality of surfaces forming the housing.

10. The liquid ejection apparatus according to claim 9, wherein the surface of the housing wall to which the ink tanks are fixed is an upper surface of the housing.

11. The liquid ejection apparatus according to claim 9, wherein the surface of the housing wall to which the ink tanks are fixed is a side surface of the housing.

12. The liquid ejection apparatus according to claim 11, wherein a shape of at least one of the ink tanks includes a shape which combines two ink tanks having elongate shapes extending in one direction while orienting the ink tanks in directions not parallel to each other.

13. The liquid ejection apparatus according to claim 8, wherein
the plurality of ink tanks are connected to tubes each including an ink filling port, and
the ink filling ports are gathered at a portion of the housing.

14. The liquid ejection apparatus according to claim 8, wherein
each of the plurality of ink tanks includes an ink filling port which enables refill of the ink tank with an ink from outside without using a tube, and
the ink filling ports are gathered at a portion of the housing.

15. The liquid ejection apparatus according to claim 1, wherein a lowermost portion in a direction of gravitational force of the ink tank is located at a position higher than an ejection surface of the liquid ejection head.

16. The liquid ejection apparatus according to claim 1, wherein the ink tank includes an ink discharge hole configured to discharge the ink to the liquid ejection head, and a width of the ink tank is gradually reduced toward the ink discharge hole.

17. The liquid ejection apparatus according to claim 1, wherein the ink tank includes an ink supply hole, and an ink filling port used to refill with an ink from outside is formed at a portion of the housing wall to which the ink tank is fixed, the portion being located at a position opposed to the ink supply hole of the fixed ink tank.

18. A liquid ejection apparatus comprising:

at least one ink tank which is ink-refillable from outside;

a liquid ejection head configured to eject an ink supplied from the ink tank; and a housing configured to contain the liquid ejection head inside, wherein the liquid ejection apparatus includes a tank attachment unit configured to attach the at least one ink tank to a housing wall of at least one surface out of a plurality of surfaces forming the housing, the tank attachment unit is fixed to the housing wall; and wherein the tank attachment unit is fixed to the housing wall such that a total thickness of the attached ink tank and the housing wall becomes smallest.

19. A liquid ejection apparatus comprising:

at least one ink tank which is ink-refillable from outside;

a liquid ejection head configured to eject an ink supplied from the ink tank; and a housing configured to contain the liquid ejection head inside, wherein the liquid ejection apparatus includes a tank attachment unit configured to attach the at least one ink tank to a housing wall of at least one surface out of a plurality of surfaces forming the housing, the tank attachment unit is fixed to the housing wall; and wherein the tank attachment unit fixed to the housing wall is configured to establish communication between outside and inside of the housing in a state where the ink tank is not attached, and to shut off the communication between the outside and the inside of the housing in a state where the ink tank is attached.

* * * * *